United States Patent [19]

Winnik et al.

[11] Patent Number: 4,902,598

[45] Date of Patent: Feb. 20, 1990

[54] PROCESS FOR THE PREPARATION OF SILICA CONTAINING CHARGE ENHANCING ADDITIVES

[75] Inventors: Francoise M. Winnik, Toronto; Yves Deslandes, Gloucester, both of Canada

[73] Assignee: Xerox Corporation, Stamford, Conn.

[21] Appl. No.: 214,351

[22] Filed: Jul. 1, 1988

[51] Int. Cl.[4] ..... G03G 9/10

[52] U.S. Cl. ..... 430/110; 430/111

[58] Field of Search ..... 430/110, 109, 111

[56] References Cited

U.S. PATENT DOCUMENTS

| | | | |
|---|---|---|---|
| 4,298,672 | 11/1981 | Lu | 430/108 |
| 4,621,039 | 11/1986 | Ciccarelli et al. | 430/106 |
| 4,680,245 | 7/1987 | Suematsu et al. | 430/110 |
| 4,681,829 | 7/1987 | Grushkin | 430/110 |
| 4,775,520 | 10/1988 | Unger et al. | 423/335 |
| 4,789,614 | 12/1988 | Bugner et al. | 430/110 |

FOREIGN PATENT DOCUMENTS

| | | |
|---|---|---|
| 3208635 | 10/1982 | Fed. Rep. of Germany . |
| 3330380 | 2/1984 | Fed. Rep. of Germany . |
| 55-79454 | 6/1980 | Japan . |
| 57-78550 | 5/1982 | Japan . |
| 57-79951 | 5/1982 | Japan . |
| 57-129446 | 8/1982 | Japan . |

*Primary Examiner*—John L. Goodrow

*Attorney, Agent, or Firm*—E. O. Palazzo

[57] ABSTRACT

A process for the preparation of silica based charge enhancing additives which comprises the reaction of a tetraalkoxysilane with an alcoholic alkaline solution in the presence of a soluble charge enhancing additive.

15 Claims, No Drawings

PROCESS FOR THE PREPARATION OF SILICA CONTAINING CHARGE ENHANCING ADDITIVES

BACKGROUND OF THE INVENTION

This invention is generally directed to processes for the preparation of silica containing charge enhancing additives. More specifically, the present invention is directed to processes for the preparation of silica containing charge enhancing additives by the hydrolysis/-condensation of tetraalkoxysilanes in the presence of charge enhancing additives such as distearyl dimethyl methylsulfate. With the process of the present invention, there is obtained in an economical, substantially one step method the preparation of charge enhancing additives sorbed on silica, particularly colloidal silica in a uniform and continuous manner. In addition, the process of the present invention enables products with particle size control and desirable surface property characteristics. In addition, with the process of the present invention there is selected an aqueous solution of readily available economical reaction components. Advantages associated with the one step economical processes of the present invention include obtaining a uniform distribution of the charge additive on the silica; minimization of the hazards relating to the processing of fine powders; increased control of the chemical composition and the average diameter particle size of the resulting charge additive; and improved electrical performance and flow characteristics, especially when the charge additive products are selected for toner compositions. The treated silica charge enhancing additive products obtained with the process of the present invention can be selected as external additives for toner compositions, including magnetic, black and colored toner compositions. Developer compositions with the modified charge enhancing additives of the present invention are useful for enabling the development of electrostatic latent images including color images. More specifically, toner compositions with the aforementioned modified charge enhancing additives are particularly useful in electrophotographic imaging processes having incorporated therein a Viton coated fuser roll since these additives do not react substantially with Viton causing undesirable decomposition thereof which adversely effects imaging quality. Also, toner compositions with the treated additives of the present invention possess improved admix characteristics while enabling colored toner compositions with high concentrations of colorant. Additionally, the modified charge enhancing additives of the present invention are of acceptable fusing performance characteristics in that, for example, these additives have substantially no effect on fusing performance; and further, the additives of the present invention are compatible with, for example, many alternative types of fuser rolls inclusive of Viton, Teflon, fluorinated ethylene polymers, silicones, and the like.

There are disclosed in a number of prior art patents developer compositions with charge enhancing additives. Thus, for example, there are illustrated in U.S. Pat. No. 3,893,935 toner compositions with certain quaternary ammonium salts as charge enhancing additives. Further, in U.S. Pat. No. 2,986,521 reversal developer compositions comprised of toner resin particles coated with finely divided colloidal silica are illustrated. According to the disclosure of this patent, development of electrostatic latent images on negatively charged surfaces is accomplished by applying a developer composition with a positively charged triboelectric relationship in respect to the colloidal silica. Moreover, toner compositions with sulfate and sulfonate charge enhancing additives are described in U.S. Pat. No. 4,338,390, the disclosure of which is totally incorporated herein by reference. Also, U.S. Pat. No. 4,298,672, the disclosure of which is totally incorporated herein by reference, illustrates toner compositions with alkyl pyridinium halide charge enhancing additives.

Other documents disclosing toner compositions with charge control additives include U.S. Pat. Nos. 3,944,493; 4,007,293; 4,079,014 and 4,394,430. Also of interest are Japanese Patent Abstract Publications 55079-454; 57129-446; 57079-951; 57078-550; and German DE 3208635. Disclosed in the '454 abstract is a dry processable electrophotographic developer with a hard powder, such as aluminum oxide which has been previously subjected to surface treatment. The '446 document discloses an electrophotographic developer with silica fine powder as a charge control agent; while the '951 abstract illustrates a photographic developer containing a micropowder of silicate coated with alumina, and having a stable frictional charge between a developer and toner in a sleeve. In the German publication '635, there are disclosed toner particles and additive particles incorporated for the primary purpose of improving flowability. In the abstract of the aforementioned publication, there is mentioned as a charge control agent a metal complex dye; and further that hydrophobic colloidal silica can be selected as a flow additive. Additionally, chemically modified surface additives such as Aerosil have been disclosed in West German patent publication DE 3330380. Specifically, this publication is directed to alkoxyaminosilanes which are chemically reacted with free silanol groups.

Toner compositions with many of the above described charge enhancing additives, including those obtained by the process of the present invention, can be selected for the development of images formed on layered photoresponsive imaging devices comprised of photogenerating layers and transport layers, reference U.S. Pat. No. 4,265,990 the disclosure of which is totally incorporated herein by reference. These devices are charged negatively, rather than positively as is usually the situation with selenium photoreceptors, thus a toner composition which is positively charged is selected to enable toner particles to be suitably attracted to the electrostatic latent image contained on the photoreceptor surface. Thus, efforts have been devoted to obtaining developer compositions containing toner resins which are positively charged. Thus, there continues to be a need for preparation processes that will enable charge enhancing additives, especially those that will not interact with fuser rolls. Moreover, there continues to be a need for preparation processes that will provide charge control additives which are stable at high temperatures. Also, there continues to be a need for preparation processes that will permit the formation of charge enhancing additives for positively or negatively charged toner and developer compositions with rapid admix charging characteristics. Additionally, there is a need for preparation processes wherein silica based external charge control additives result, which additives in addition to being thermally stable, are substantially nontoxic. Also, there is need for colored toner compositions which contain positively or negatively charged resin particles with the silica based charge enhancing additives obtained by the process of the present invention, and wherein the resulting toner compositions have desirable toner admix charging. Specifically, there is a need for toner compositions having sorbed thereon modified charge enhancing additives as illustrated herein, which toner compositions can be negatively or positively charged depending, for example, on the carrier components selected; possess improved admix characteristics, that is the toner compositions acquire their charge in a rapid time period, less than 1 minute for example, while simultaneously possessing other improved characteristics as illustrated hereinafter, inclusive of acceptable electrical properties such as an appropriate positive or negative triboelectric charge.

SUMMARY OF THE INVENTION

It is an object of the present invention to provide processes for the preparation of charge enhancing additives.

In another object of the present invention there are provided positively or negatively charged toner compositions with silica based charge enhancing additives obtained by the hydrolysis/condensation of alkoxysilanes in the presence of the aforesaid charge additives.

Another object of the present invention resides in the provision of chemically modified charge enhancing additives which do not interact and/or attack fuser rolls, including those comprised of Viton rubber selected for use in imaging processes.

In another object of the present invention there is provided a developer composition with positively or negatively charged toner particles, carrier particles, and specific charge enhancing additives which are prepared in accordance with the processes illustrated herein.

Further, in another object of the present invention there are provided positively charged toner compositions which are water insensitive and have desirable admix properties.

In a further object of the present invention there are provided magnetic toner compositions, and colored toner compositions with positively charged or negatively charged toner particles, carrier particles, and specific charge enhancing additives sorbed onto flow aid additives, which are prepared in accordance with the processes illustrated herein.

Additionally, in another object of the present invention there are provided toner compositions with improved electrical properties inclusive of rapid admix times; and an appropriate triboelectric charging value of a positive or negative polarity, which compositions may be black in appearance or include therein other colorants such as cyan, magenta, yellow, red, blue and green.

In yet additional object of the present invention there are provided developer compositions comprised of toner particles with a modified charge enhancing additive as illustrated herein, and carrier particles, which compositions are useful for affecting the development of images in electrostatographic imaging processes.

These and other objects of the present invention are accomplished by providing toner compositions comprised of resin particles, pigment particles, and modified charge enhancing additives. By chemically modified, in accordance with the present invention, is meant the sorption of the charge enhancing additives onto silica.

Accordingly, in one specific embodiment of the present invention there are provided toner compositions comprised of thermoplastic resin particles and pigment particles selected, for example, from the group consisting of black, cyan, magenta, yellow, red, blue and mixtures thereof; and wherein the toner composition has present on its surface, for example, in an amount of from about 0.5 percent by weight based on the weight of the toner composition, silica based charge enhancing additives, which compositions are prepared by the hydrolysis/condensation of tetraalkoxysilanes in the presence of soluble charge enhancing additives. In a more specific embodiment of the present invention, the modified charge enhancing additive can be comprised of about 10 percent of charge control additive sorbed onto about 90 percent of the silica component.

Accordingly, in one embodiment of the present invention the process is directed to the preparation of silica based charge enhancing additives wherein the charge enhancing additive is sorbed on the silica, which process comprises the reaction of a tetraalkoxysilane with an alcoholic alkaline solution in the presence of a charge enhancing additive. Further, there can be selected for the aforementioned process mixtures of water and the alcoholic alkaline solution, which mixtures contain from about 0.5 percent to about 30 percent by weight of water, and from about 70 percent to about 99.5 percent by weight of the alcoholic alkaline component; or mixtures of the alcoholic alkaline component, water, and a solvent such as acetone, dioxane, and the like, which mixtures contain from about 70 percent to about 99.5 percent by weight of alcohol; from about 0.5 percent to about 30 percent by weight of water; and from about 1 percent to about 30 percent by weight of solvent. Preferably, the alcoholic alkaline solution is an alcoholic ammonia solution.

More specifically, the process of the present invention comprises the reaction of soluble tetraethoxysilanes with ethanolic ammonia in the presence of a soluble charge control additive. Specifically, the process of the present invention in one embodiment initially comprises the preparation of a solution of a charge additive, from about 0.1 to about 20 weight percent, into a mixture of water and alcohol comprised of from about 0.5 to about 30 weight percent of water. After complete dissolution of the charge controlling additive, concentrated aqueous alkaline component, such as ammonium hydroxide, can be added to the solution in amounts of from about 2 to about 40 weight percent. To this solution retained at a temperature from about −20° to about +50° C. is added a tetraalkoxysilane in an amount such that is concentration in the reaction mixture is from about 1 to about 10 weight percent. The mixture is then stirred or shaken at a constant temperature of from about −20° to about +50° C. for reaction times ranging from about 2 hours to about 48 hours. After completion of the reaction, the mixture is brought to room temperature. The pH of the mixture is then adjusted to a value ranging from about 6.0 to about 8.0 by addition of hydrochloric acid. The silica based charge enhancing material is isolated by a suitable method, such as for example centrifugation, and the isolated material is then treated with water by known techniques such as ultrafiltration until the specific conductance of the water has reached a value of 30 micromhocm$^3$ or less. Also, the silica based charge enhancing material product resulting is subsequently dried by freeze drying or spray drying. The amount of charge enhancing material on the surface of the silica is determined by analytical techniques such as elemental analysis and X-Ray Photoelectron Spectroscopy, and the size (average particle diameter) of the silica based charge enhancing additive is measured by Transmission Electron Microscopy or Photon Correlated Spectroscopy of suspensions of the material in a suitable liquid medium, such as for example water or alcohol. The morphology of the product particles is determined by Transmission Electron Microscopy.

Illustrative examples of tetraalkoxysilanes selected for the process of the present invention usually in an amount of from about 1 to about 10 weight percent, include tetramethoxysilane, tetraethoxysilane, tetra-n-propoxysilane, tetra-i-propoxysilane, tetra-n-butoxysilane, tetra-s-butoxysilane, tetra-i-butoxysilane, tetrapentoxysilane, tetrakis-(2-methoxyethoxy)silane, and the like. Generally, tetraalkoxysilanes wherein alkoxy contains from 1 to about 15, and preferably from 1 to about 5 carbon atoms can be selected provided the objectives of the present invention are achievable.

Examples of preferred solvent alcohols utilized for the process of the present invention in an amount of from about 60 to about 100 weight percent include ethanol, methanol, propanol, n-butanol, i-butanol, t-butanol, pentanol, mixtures thereof, and the like. Generally, aliphatic alcohols with a carbon chain length of from 1 to about 10, and preferably from about 1 to about 8 carbon atoms can be selected provided the objectives of the present invention are achievable. Other examples of solvents suitable for the process of the present invention include mixtures of an alcohol and a miscible organic solvent, such as for example acetone, 3-pentanone, dioxane, and tetrahydrofuran. The organic solvent is present in amount of from about 5 to about 30 weight percent of the total reaction mixture.

As sources of ammonia, there can be selected concentrated aqueous ammonium hydroxide, gaseous ammonia, and ammonium salts, such as for example ammonium acetate, ammonium chloride, and ammonium nitrate. In addition, the ammonia can be replaced by an organic amine such as methylamine and ethylamine, provided the objectives of the present invention are achievable.

Charge enhancing additives that may be selected for the process of the present invention include alkyl pyridinium halides, reference U.S. Pat. No. 4,298,672, the disclosure of which is totally incorporated herein by reference; the organic sulfates and sulfonates of U.S. Pat. No. 4,338,930, the disclosure of which is totally incorporated herein by reference; alkyl ammonium sulfates as illustrated in U.S. Pat. No. 4,560,635, the disclosure of which is totally incorporated herein by reference; and other similar charge enhancing additives providing the objectives of the present invention are accomplished. Specific examples of the aforementioned additives include cetyl pyridinium chloride, cetyl pyridinium tetrafluoroborate, cetyl pyridinium hexafluoroborate, stearyl dimethylphenethyl ammonium paratoluene sulfonate, and distearyl dimethyl ammonium methyl sulfate.

There is obtained with the process of the present invention charge enhancing additives comprised of silica on which are sorbed charge controlling agents in an amount of from about 0.01 weight percent to about 10 weight percent, and preferably from about 0.5 weight percent to about 5 weight percent. Other percentages may be selected providing the objectives of the present invention are achievable.

Illustrative examples of suitable toner resins selected for the toner and developer compositions include polyamides, epoxies, diolefins, vinyl resins and polymeric esterification products of a dicarboxylic acid and a diol comprising a diphenol. Various suitable vinyl resins may be selected including homopolymers or copolymers of two or more vinyl monomers including styrene, p-chlorostyrene, unsaturated mono-olefins such as ethylene, propylene, butylene, isobutylene and the like; vinyl halides inclusive of vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile; ;methacrylonitrile; and acrylamide; vinyl ethers, such as vinyl methyl ether, vinyl isobutyl ether, and vinyl ethyl ether; styrene butadiene copolymers; and mixtures thereof.

As one preferred toner resin, there can be selected the esterification products of a dicarboxylic acid and a diol comprising a diphenol. These materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bisphenol A and propylene oxide, followed by the reaction of the resulting product with fumaric acid, branched polyester resins resulting from the reaction of dimethylterephthalate, 1,3-butanediol, 1,2-propanediol, and pentaerythritol, and suspension and emulsion styrene butadiene resins as illustrated in U.S. Pat. Nos. 4,558,108 and 4,469,770, the disclosures of which are totally incorporated herein by reference.

The resin particles are present in a sufficient, but effective amount; thus, when 10 percent by weight of pigment or colorant such as carbon black is contained therein, about 90 percent by weight of resin material is selected. Generally, from about 0.1 weight percent to about 2.0 weight percent, and preferably from about 0.1 weight percent to about 0.7 weight percent of silica based charge enhancing additive is selected for mixing with the toner composition; thus this additive is usually present as an external component, however, the charge enhancing additive of the present invention can be used in other amounts providing the objectives of the present invention are accomplished.

Numerous well known suitable pigments or dyes can be selected as the colorant for the toner particles including, for example carbon black, nigrosine dye, aniline blue, magnetites, and mixtures thereof. The pigment, which is preferably carbon black, should be present in a sufficient amount to render the toner composition colored, thus permitting the formation of a clearly visible image. Generally, pigment particles such as carbon black are present in amounts of from about 3 percent by weight to about 20 percent by weight, based on the total weight of the toner composition; however, lesser or greater amounts of pigment particles can be selected providing the objectives of the present invention are achieved.

When the pigment particles are comprised of magnetites, which are a mixture of iron oxides ($FeO \cdot Fe_2O_3$), including those commercially available as Mapico Black, they are present in the toner composition in an amount of from about 10 percent by weight to about 70 percent by weight, and preferably in an amount of from about 15 percent by weight to about 50 percent by weight.

Also embraced within the scope of the present invention are colored toner compositions comprised of toner resin particles, the silica based charge enhancing additive illustrated herein; and as pigment or colorants components selected from the group consisting of magenta, cyan, yellow, known red, blue, green, and mixtures thereof. More specifically, with regard to the generation of color images utilizing developer composition containing the silica based charge enhancing material obtained by the processes of the present invention illustrative examples of magenta materials that may be selected as pigments include, for example, 2,9-dimethyl-substituted quinacridone and anthraquinone dye identified in the Color Index as Cl 60710, Cl Dispersed Red 15, a diazo dye identified in the Color Index as Cl 26050, Cl Solvent Red 19, and the like. Illustrative examples of cyan materials that may be used as pigments are copper tetra-4(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro2,5-dimethoxy acetoacetanilide, Permanent Yellow FGL, and the like. These pigments, when used with the charge enhancing additives of the present invention, are generally present in the toner composition in an amount of from about 2 weight percent to about 15 weight percent based on the weight of the toner resin particles.

Illustrative examples of carrier components that can be selected for mixing with the toner compositions described herein include those that are capable of triboelectrically obtaining a charge of opposite polarity to that of the toner. Accordingly, the carrier particles of the present invention can be selected to be of a negative polarity thus permitting the toner composition, which is positively charged to adhere to and surround the carrier components. Illustrative examples of carrier cores include steel, nickel, iron, ferrites, reference for example U.S. Pat. No. 4,042,518, the disclosure of which is totally incorporated herein by reference; and the like, reference U.S. Pat. Nos. 3,590,000; 4,298,672; and 4,560,635, the disclosures of which are totally incorporated herein by reference. Additionally, there can be selected as carrier particles nickel berry carriers as disclosed in U.S. Pat. No. 3,847,604, which carriers are comprised of nodular carrier beads of nickel, characterized by surfaces of reoccuring recesses and protrusions thereby providing particles with a relatively large external area.

The selected carrier particles generally contain thereover a coating, for example, of halogenated polymers with optional additives thereon, such as carbon black, which assist in enabling the toner composition to acquire a positive charge, and terpolymers which permit the toner composition to acquire a negative charge. Specifically, there can be selected as coatings for enabling positively charged toner compositions fluoropolymers, inclusive of polyvinylidene fluorides; tetrafluoroethylenes; copolymers of vinyl chloride, and trichlorofluoethylene; and for enabling negatively charged toner compositions, terpolymers of styrene, methylmethacrylate, and a silane, such as triethoxy silane, reference for example U.S. Pat. Nos. 3,467,634; and 3,526,533, the disclosures of which are totally incorporated herein by reference. These coatings are generally present in an amount of from about 0.1 percent by weight to about 5 percent by weight of the carrier core.

Also, the diameter of the carrier particles are generally of from about 50 microns to about 1,000 microns thus allowing these particles to possess sufficient density and inertia to avoid adherence to the electrostatic images during the development process. The carrier particles can be mixed with the toner particles in various suitable combinations, however, best results are obtained when about 1 to about 5 parts of toner to about 10 parts to about 200 parts by weight of carrier are mixed.

The toner compositions illustrated herein can be prepared by a number of known methods, including melt blending the toner resin particles, pigment particles or colorants; followed by mechanical attrition; and thereafter adding to the toner composition surface the silica based charge enhancing additives prepared by the process of the present invention. Other methods include those well known in the art such as spray drying, melt dispersion, dispersion polymerization, and suspension polymerization. The resulting toner compositions possess positively or negatively charged toner composition depending on the carrier materials selected. These developer mixtures, especially the toner compositions, exhibit the improved properties as mentioned hereinbefore.

Further, the toner and developer compositions described herein may be selected for use in developing images in electrophotographic imaging systems containing therein conventional photoreceptors, such as selenium. Also useful are organic photoreceptors, illustrative examples of which include layered photoresponsive devices comprised of transport layers and photogenerating layers, reference U.S. Pat. No. 4,265,990, the disclosure of which is totally incorporated herein by reference; and other similar layered photoresponsive devices. Examples of generating layers include trigonal selenium, metal phthalocyanines, metal free phthalocyanines and vanadyl phthalocyanines, while examples of charge transport layers include the aryl diamines as disclosed in U.S. Pat. No. 4,265,990. Other photoresponsive devices useful in the present invention are polyvinylcarbazole 4-dimethylaminobenzylidene; benzhydrazide; 2-benzylidene-aminocarbazole; 4-dimethylamino-benzylidene; (2-nitrobenzylidene)-p-bromoaniline; 2,4-diphenyl-quinazoline; 1,2,4-triazine; 1,5-diphenyl-3-methyl pyrazoline; 2-(4'-dimethyl-amino phenyl)-benzoaxzole; 3-aminocarbazole; polyvinyl carbazole-trinitrofluorenone charge transfer complex; squaraines; selenium alloys; and hydrogenated amorphous silicon.

The following examples are submitted to further define various aspects of the present invention. These examples are intended to illustrate and not limit the scope of the present invention. Parts and percentages are by weight unless otherwise indicated.

EXAMPLE I

Cetyl pyridinium chloride, 0.08 gram, was dissolved in absolute ethanol, 90 milliliters, contained in a narrow-necked 125 milliliter bottle. Concentrated ammonium hydroxide, 6.0 milliliters, then tetraethoxysilane, 4.0 milliliters, was added to the bottle. The reaction vessel bottle was capped immediately and placed in a thermostatted shaker bath set at 25° C., where it was shaken for 24 hours. Thereafter, the insoluble white particles formed were separated from the mixture by centrifugation at 15° C., 10,000 rpm for 10 minutes. Subsequently, the white particles were resuspended in water, 100 milliliters. The pH of the suspension was adjusted to 7.5 by addition of a few drops of hydrochloric acid. The particles were washed repeatedly with water by ultrafiltration with a Minitan Acrylic System from Millipore, Inc. The suspension of the purified particles in water was concentrated to approximately 20 milliliters. The particles were then isolated from this suspension by freeze drying for 48 hours. There resulted a fine white powder, 0.7 gram, 70 percent yield, which particles had an average volume diameter of 150 nanometers ad determined by TEM. The incorporation (sorption) of the cetyl pyridinium chloride on the silica white powder was confirmed by elemental analysis for nitrogen content (0.26 percent) and by X-ray photoelectron spectroscopy.

EXAMPLE II

Distearyl dimethyl ammonium methylsulfate, 0.64 gram, was dissolved in absolute ethanol, 720 milliliters, contained in a 1 liter roundbottom flask. Concentrated ammonium hydroxide, 48.0 milliliters, was added first, then tetraethoxysilane, 32.0 milliliters, to the bottle. The reaction vessel bottle was closed immediately. The reaction mixture was stirred magnetically at room temperature for 18 hours. Thereafter, the insoluble white particles were separated from the mixture by centrifugation at 15° C., 10.000 rpm for 10 minutes. The particles were resuspended in water, 1,000 milliliters, and the pH of the suspension was adjusted to 7.5 by addition of a few drops of hydrochloric acid. Subsequently, the particles were washed repeatedly with water by ultrafiltration with a Minitan Acrylic System from Millipore, Inc., and the suspension of the purified particles in water was concentrated to approximately 100 milliliters. The particles were then isolated from this suspension by freeze drying for 48 hours. There resulted a fine white powder, 8.7 grams, 70.5 percent yield, which particles had an average volume diameter of 400 nanometers as determined by TEM. The incorporation of the distearyl dimethylammonium methylsulfate on the silica white powder was confirmed by elemental analysis for nitrogen content (0.44 percent) and by X-ray photoelectron spectroscopy.

EXAMPLE III

Cetyl pyridinium chloride, 0.16 gram, was dissolved in a mixture of absolute ethanol, 43 milliliters, and water, 39.5 milliliters, contained in a narrow-necked 125 milliliter bottle. Concentrated ammonium hydroxide, 13.5 milliliters, was added, then tetraethoxysilane, 4.0 milliliters. The reaction vessel bottle was capped immediately and placed in a thermostatted shaker bath set at 25° C., and shaken for 24 hours. Thereafter, the insoluble white particles were separated from the mixture by centrifugation at 15° C., 10,000 rpm for 10 minutes. The white particles were then resuspended in water, 100 milliliters, and the pH of the suspension was adjusted to 7.5 by addition of a few drops of hydrochloric acid. The particles were washed repeatedly with water by ultrafiltration with a Minitan Acrylic System from Millipore, Inc. The suspension of the purified particles in water was concentrated to approximately 20 milliliters. Subsequently, the particles were isolated from this suspension by freeze drying for 48 hours. There resulted a fine white powder, 0.68 gram, 68 percent yield, which particles had an average volume diameter of 300 nanometers as determined by TEM. The incorporation of the cetyl pyridinium chloride on the silica white powder was confirmed by elemental analysis for nitrogen content (0.36 percent) and by X-ray photoelectron spectroscopy.

EXAMPLE IV

The procedure of Example III was repeated with the exception that there was selected in place of the cetyl pyridinium chloride, distearyl dimethyl ammonium methylsulfate, 0.16 gram, and substantially similar results were obtained. The particles had an average size of 350 nanometers and a nitrogen content of 0.25 percent, as determined by elemental analysis.

EXAMPLE V

Cetyl pyridinium chloride, 0.08 gram, was dissolved in a mixture of absolute ethanol, 60 milliliters, and water, 2.0 milliliters, contained in a narrow-necked 125 milliliter bottle. Concentrated ammonium hydroxide, 36.0 milliliters, was added, then tetraethoxysilane, 4.0 milliliters. The reaction vessel bottle was capped immediately and placed in a thermostatted shaker bath set at 25° C., and shaken for 24 hours. Thereafter, the insoluble white particles were separated from the mixture by centrifugation at 15° C., 10,000 rpm for 10 minutes. The white particles were then resuspended in water, 100 milliliters. The pH of the suspension was adjusted to 7.5 by addition of a few drops of hydrochloric acid. The particles were washed repeatedly with water by ultrafiltration with a Minitan Acrylic System from Millipore, Inc. The suspension of the purified particles in water was concentrated to approximately 20 milliliters, and the particles were isolated from this suspension by freeze drying for 48 hours. There resulted a fine white powder, 0.72 gram, 72 percent yield, which particles had an average volume diameter of 700 nanometers as determined by TEM. The incorporation of the cetyl pyridinium chloride on the silica white powder was confirmed by elemental analysis for nitrogen content (0.18 percent) and by X-ray photoelectron spectroscopy.

EXAMPLE VI

The procedure of Example V was repeated with the exception that there was selected in place of the cetyl pyridinium chloride, distearyl dimethyl ammonium methylsulfate, 0.08 gram, and substantially similar results were obtained. The particles had an average size of 700 nanometers and a nitrogen content of 0.17 percent as determined by elemental analysis.

EXAMPLE VII

Distearyl dimethyl ammonium methylsulfate, 1.5 grams, was dissolved in a mixture of methanol, 30.0 milliliters, acetone, 160 milliliters, and water, 10.0 milliliters, contained in a 500 milliliter round-bottom flask. Concentrated ammonium hydroxide, 35.0 milliliters, was added, then tetramethoxysilane, 20.0 milliliters. The reaction flask vessel was closed immediately. The reaction mixture was then stirred magnetically at room temperature for 18 hours. Thereafter, the insoluble white particles resulting were separated from the mixture by centrifugation at 15° C., 10,000 rpm for 10 minutes. The particles were then resuspended in water, 1,000 milliliters, and the pH of the suspension was adjusted to 7.5 by addition of a few drops of hydrochloric acid. Subsequently, the particles were washed repeatedly with water by ultrafiltration with a Minitan Acrylic System from Millipore, Inc. The suspension of the purified particles in water was concentrated to approximately 100 milliliters. The particles were isolated from this suspension by freeze drying for 48 hours. There resulted a fine white powder, 6.2 grams, which particles had an average volume diameter of 360 nanometers as determined by TEM. The incorporation of the distearyl dimethyl ammonium methylsulfate on the silica white powder was confirmed by elemental analysis for the nitrogen content (0.27 percent) and by X-ray photoelectron spectroscopy.

EXAMPLE VIII

The procedure of Example VII was repeated with the exception that there was selected in place of the distearyl dimethyl ammonium methylsulfate, cetyl pyridinium chloride, 1.5 grams, and substantially similar results were obtained. The particles had an average size of 200 nanometers and a nitrogen content of 0.15 percent as determined by elemental analysis.

EXAMPLE IX

Distearyl dimethyl ammonium methylsulfate, 0.5 gram, was dissolved in a mixture of n-butanol, 100.0 milliliters, and water, 35.0 milliliters contained in a 500 milliliter round-bottom flask. Concentrated ammonium hydroxide, 35.0 milliliters, was added, then tetra-n-butoxysilane, 10.0 milliliters. The reaction vessel was closed immediately. The reaction flask mixture was stirred magnetically at room temperature for 18 hours. Thereafter, the insoluble white particles were separated from the mixture by centrifugation at 15° C., 10,000 rpm for 10 minutes. The particles were then resuspended in water, 1,000 milliliters, and the pH of the suspension was adjusted to 7.5 by addition of a few drops of hydrochloric acid. Subsequently, the particles were washed repeatedly with water by ultrafiltration with a Minitan Acrylic System from Millipore, Inc. The suspension of the purified particles in water was concentrated to approximately 100 milliliters. The particles were isolated from this suspension by freeze drying for 48 hours. There resulted a fine white powder, 4.2 grams, which particles had an average volume diameter of 650 nanometers as determined by TEM. The incorporation of the distearyl dimethyl ammonium methylsulfate on the silica white powder was confirmed by elemental analysis for the nitrogen content (0.16 percent) and by X-ray photoelectron spectroscopy.

EXAMPLE X

The procedure of Example IX was repeated with the exception that there was selected in place of the distearyl dimethyl ammonium methylsulfate, cetyl pyridinium chloride, 0.5 gram, and substantially similar results were obtained. The particles had an average size of 420 nanometers, and a nitrogen content of 0.18 percent, as determined by elemental analysis.

EXAMPLE XI

A. Toner Preparation:

There was prepared a toner composition by melt blending at a temperature of 100° C., followed by mechanical attrition, 87 percent by weight of a styrene butadiene resin containing 89 percent by weight of styrene, and 11 percent by weight of butadiene, commercially available from Goodyear Chemical Company as Pliolite, 3 percent by weight of carbon black Regal® 330, and 10 percent by weight of magnetite. The resulting toner was classified in order to remove particles smaller than 5 microns in diameter.

To the above prepared toner, 100 parts, was added 0.5 part of the silica based charge control additive obtained from the process of Example I by blending with roll milling for ½ hour using 5 parts of ⅛ inch steel shot to 1 part toner. The steel shot was then removed by sieving.

There resulted a toner composition with the styrene butadiene resin, and on the surface thereof 0.5 percent by weight of the silica based charge control additive of Example I.

B. Developer Preparation:

A developer composition was then prepared by admixing 3 percent by weight of the above-prepared toner composition with 97 percent by weight of carrier particles comprised of a steel core with a coating thereover of 1.34 weight percent of a copolymer of vinyl chloride and chlorotrifluoroethylene, and dispersed therein 5 percent of Regal® 330 carbon black. There resulted on the toner composition a positive triboelectric charge of 22.3 microcoulombs per gram, and further the admix time for this toner was 40 seconds.

EXAMPLE XII

A. Toner Preparation:

There was prepared a toner composition by melt blending at a temperature of 100° C., followed by mechanical attrition, a styrene butadiene resin containing 89 percent by weight of styrene, and 11 percent by weight of butadiene, commercially available from Goodyear Chemical Company as Pliolite, 3 percent by weight of carbon black Regal® 330, and 10 percent by weight of magnetite. The resulting toner was classified in order to remove particles smaller than 5 microns in diameter.

To the above prepared toner, 100 parts, was added 0.5 part of the silica based charge control additive obtained from the process of Example I by blending with roll milling for ½ hour using 5 parts of ⅛ inch steel shot to 1 part toner. The steel shot was then removed by sieving.

There resulted a toner composition with the styrene butadiene resin, and on the surface thereof 0.5 percent by weight of the silica based charge control additive prepared as described in Example II.

B. Developer Preparation:

A developer composition was then prepared by admixing 3 percent by weight of the above-prepared toner composition with 97 percent by weight of carrier particles comprised of a steel core with a coating thereover of 1.34 weight percent of a copolymer of vinyl chloride and chlorotrifluoroethylene, and dispersed therein 10 percent of Regal® 330 carbon black. There resulted on the toner composition a triboelectric charge of 28.5 microcoulombs per gram, and further the admix time for this toner was 30 seconds.

The developer compositions of Examples XII and XIII were then selected for developing images in a xerographic imaging test device containing a layered photoreceptor comprised of a Mylar substrate overcoated with a photogenerating layer of trigonal selenium dispersed in a polyvinyl carbazole binder, and as a top layer in contact with the photogenerating layer charge transport molecules N,N'-diphenyl-N,N'-bis(3-methylphenyl)1,1'-biphenyl-4,4'-diamine dispersed in a polycarbonate resin commercially available as Makrolon, which device was prepared in accordance with the disclosure of U.S. Pat. No. 4,265,990; and there resulted high quality images with substantially no background deposits. The device selected also contained a Viton fuser roll, and visual observation after 50,000 imaging cycles indicated that no damage occured to the Viton fuser roll, that is the Viton did not turn black, did not crack and the surface did not harden; but rather remained smooth and soft although very slightly darkened because of the reaction of the cetyl pyridinium chloride with the Viton fuser roll.

With further regard to the developer compositions of the present invention, there are usually included in the carrier coating various conductive or nonconductive carbon blacks including, for example, those carbon blacks commercially available as Vulcan. These carbon blacks are generally present for the purpose of controlling the insulating and/or conductive properties of the resulting developer composition. Generally, from about 5 percent by weight to about 30 percent by weight of the aforementioned carbon blacks are incorporated into the carrier coating based on the coating weight. Additionally, other modified charge enhancing additives can be selected for adding to the surface of the present invention providing the objectives thereto are achievable.

Other modifications of the present invention may occur to those skilled in the art based upon a reading of the present disclosure, and these modifications are intended to be included within the scope of the present invention.

What is claimed is:

1. A toner comprised of resin particles and a silica based charge enhancing additive prepared by reacting a tetraalkoxysilane with an alcoholic alkaline solution in the presence of a soluble charge enhancing additive to form silica particles having sorbed thereon said charge enhancing additive.

2. A toner composition comprised of resin particles and a silica based charge enhancing additive prepared by reacting a tetraalkoxysilane with an alcoholic ammonium hydroxide solution in the presence of a soluble charge enhancing additive to form silica particles having sorbed thereon said charge enhancing additive.

3. A toner composition in accordance with claim 1 wherein the charge enhancing additive is a cetyl pyridinium chloride/silica composition.

4. A toner composition in accordance with claim 1 wherein the charge enhancing additive is a distearyl dimethyl ammonium methylsulfate/silica composition.

5. A toner composition in accordance with claim 1 wherein the charge enhancing additive is a stearyl dimethyl phenethyl ammonium para-toluene sulfonate/silica composition.

6. A toner composition in accordance with claim 1 wherein the charge enhancing additive is a dimethyl distearyl ammonium methylsulfate/silica composition, and the toner is comprised of a styrene/butadiene copolymer and carbon black.

7. A developer composition comprised of the toner composition of claim 1 wherein the charge enhancing additive is a dimethyl distearyl ammonium methylsulfate/silica composition, the toner is comprised of a styrene/butadiene copolymer and carbon black, and the carrier is comprised of particles comprised of a steel core coated with a copolymer of vinyl chloride and chlorotrifluoroethylene, and dispersed therein Regal® 330 carbon black.

8. A toner composition in accordance with claim 6 with a triboelectric charge of about 28 microcoulombs per gram.

9. A toner composition in accordance with claim 6 with an admix time of from about 15 to about 40 seconds.

10. A developer composition comprised of the toner composition of claim 1 and carrier particles.

11. A developer composition comprised of the toner composition of claim 3 and carrier particles.

12. A developer composition in accordance with claim 10 wherein the carrier particles include a coating thereover.

13. A developer composition in accordance with claim 11 wherein the carrier particles include a coating thereover.

14. A developer composition in accordance with claim 12 wherein the coating is comprised of a polymer.

15. A developer composition in accordance with claim 13 wherein the coating is comprised of a polymer.

* * * * *